United States Patent [19]

Loos

[11] 4,297,761

[45] Nov. 3, 1981

[54] GARBAGE DISPOSAL UTENSIL

[75] Inventor: Evelyn J. Loos, Saratoga, Calif.

[73] Assignee: Stanley M. Weir, Santa Clara, Calif.

[21] Appl. No.: 163,392

[22] Filed: Jun. 26, 1980

[51] Int. Cl.[3] ..... A47L 25/00

[52] U.S. Cl. ..... 15/105; 15/104 R; 15/104 S; 15/236 R; 15/245; D32/40

[58] Field of Search ..... 15/104 R, 105, 236 R, 15/245; 4/295; D7/181–185; 294/1 R

[56] References Cited

U.S. PATENT DOCUMENTS 2,709,046 5/1955 Hyde ..... 4/295 X
3,427,636 2/1969 Seifert ..... 15/236 R X
3,609,776 10/1971 Haldopoulos et al. ..... 4/295 X
3,780,393 12/1973 Gaetke ..... 15/236 R X
4,137,578 2/1979 Felici ..... 15/105

FOREIGN PATENT DOCUMENTS 1231584 5/1971 United Kingdom ..... 4/295

*Primary Examiner*—Edward L. Roberts
*Attorney, Agent, or Firm*—Stanley M. Weir

[57] ABSTRACT

Disclosed is a multi-purpose garbage disposal utensil for sweeping garbage into a garbage disposer, and for safely agitating garbage to speedup and unclog feed of garbage into a garbage disposer, and for plugging a sink drain hole above a garbage disposer.

3 Claims, 4 Drawing Figures

Fig. 1
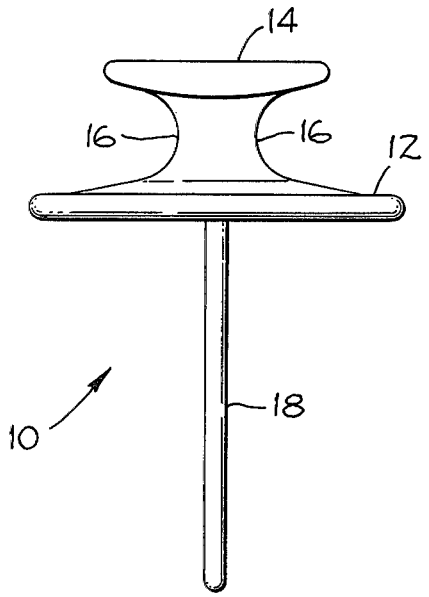
Fig. 2
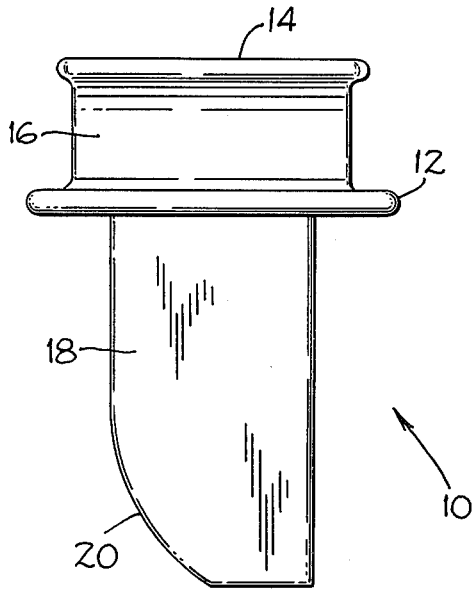
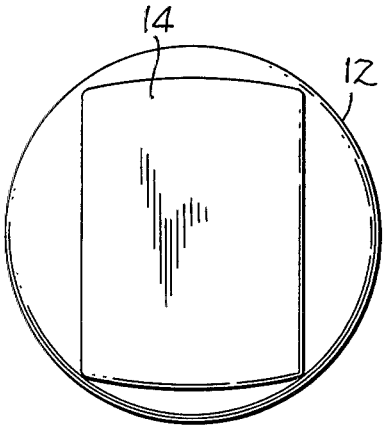
Fig. 3
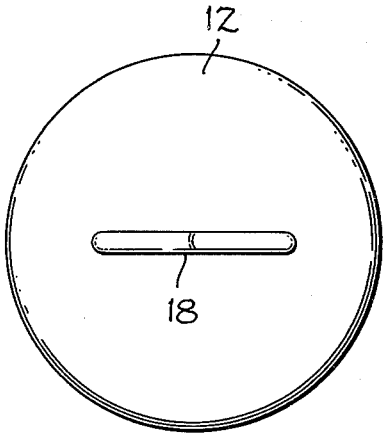
Fig. 4

GARBAGE DISPOSAL UTENSIL

DISCUSSION OF THE PRIOR ART

Powered household and commercial garbage disposers are in common use. Garbage such as peels, wilted lettuce leaves, and uneaten food from dinner plates are swept into gargage disposers with a sponge, brush, dishrag or other implement.

Running water and gravity are the means employed to feed a garbage disposer once garbage has been swept into a disposer drain hole. Sometimes it takes a disposer considerable time to clear a drainhole following sweep of garbage into it. During this time water is running, electric power is on, and the user of a disposer may be kept waiting. p Occasionally a piece of garbage such as a grapefruit-half-peel becomes lodged in a garbage disposer in such a position that the blades of the disposer are not able to grind up the piece for disposal. Clogging of this kind can be overcome by turning off the garbage disposer then reaching into the disposer drain hole and changing orientation of the piece or breaking it into smaller pieces so that the disposer can dispose of it.

Another clogging situation occurs when waste food is stuffed into a disposer drain hole such that the wedging of waste pieces together causes a food bridge to form above the disposer blades. Clogging of this kind can be overcome by pushing down on the garbage bridge or by agitating the garbage with an implement to break up the bridge.

Garbage disposers are normally equipped with a plug. This plug in addition to plugging the sink drain hole so that the sink may be filled with liquid, also serves as a safety device to keep fingers out of the disposer, to stop pieces from flying out of the disposer and to prevent hard pieces from inadvertently falling into the disposer causing the unit to jam and/or be damaged.

When using a garbage disposer it is inconvient and time consuming first to set aside the plug, second to get an implement for sweeping waste into the disposer, third to wait while water runs and the garbage disposer works at a slow gravity feed pace and fourth when finished, to put aside the sweeping implement and return the plug to the sink drain hole.

SUMMARY OF THE PRESENT INVENTION

It is therefore an object of the present invention to provide an "all-N-one" utensil which serves as a garbage disposer plug, and an implement for sweeping garbage off surfaces into a disposer, and an implement for agitating garbage fed into a disposer to overcome clogs and to speedup feed of garbage into the disposer.

Another object of the present invention is to provide an implement of ideal size and shape for scraping or sweeping waste from cook ware, dinnerware and the like into a garbage disposer and for sweeping garbage collected in a sink into a garbage disposer.

Still another object of the present invention is to provide a garbage agitator implement that can reach almost everywhere within a garbage disposer drain hole and that can be used to agitate garbage in a drain hole while the disposer is running, without danger of having this implement get caught in blades of the disposer.

Still another object of the present invention is to provide a garbage disposal utensil of simple design and low cost construction.

Briefly the preferred embodiment of the present invention includes a drain hole plug with a handle on top and a wide flexible spatula-like blade protruding from the bottom of the plug . . . said blade extending from the bottom of the plug to a position just slightly above the blades of an in-sink garbage disposer when said plug is inserted into a garbage disposer drain hole.

The major advantage of the present invention is that it provides in a single unit a very handily located utensil which performs the combined functions of: (1) an in-sink garbage disposer plug, (2) an implement for sweeping garbage off surfaces into a garbage disposer, and (3) an implement for safely agitating garbage to speedup feeding of garbage into a garbage disposer and to overcome clogging which sometimes occurs when feeding a garbage disposer.

Another advantage of the present invention is that cost savings may be made by combining in a single unit, an implement which performs several functions which otherwise requires more implements to perform.

These and other objects and advantages of the present invention will no doubt become apparent after reading the following detailed description of the preferred embodiments which are illustrated in the figures of the drawing.

IN THE DRAWING

FIG. 1 is a front elevation view of the present invention.

FIG. 2 is a side elevation view of the present invention.

FIG. 3 is a top view of the present invention.

FIG. 4 is a bottom view of the present invention.

DETAILED DESCRIPTION OF THE PREFERRED EMBODIMENTS

Referring now to FIGS. 1 through 4, there is shown a garbage disposal utensil 10 in accordance with the present invention. The disposal utensil 10 may be a single piece formed as shown in FIGS. 1 and 2, or it may be constructed of two or more pieces connected together. Rubber, pliable plastic or other suitable material may be used.

A round portion 12 of the disposal utensil serves as a plug for plugging in-sink drain holes above garbage disposers. Round member 12 may, for example, be fitted with a rubber ring (not shown) around its perimeter to insure sealing of a drain hole.

As best shown in FIG. 1, at the top of the disposer plug 12 is a handle 14 with indents 16 to aid gripping of the utensil by fingers and thumb.

A supple blade 18 protrudes from the bottom side of the plug portion 12 of utensil 10. The blade 18 is about as wide as the diameter of a disposer drain hole and long enough to reach from the bottom of plug 12 to a position just above the blades of a garbage disposer when plug 12 is plugged into an in-sink drain hole above the disposer.

The blade 18 of disposal utensil 10 may have numerous shapes and textures to suit different applications. As shown in FIG. 2, the blade may have one rounded corner 20 to facilitate cleaning left-overs out of bowls and one square corner 22 for cleaning waste out of square corner pans. It may have sponge or rough sides (not shown) to aid in dislodging food stuck to plates, pans and the like. For example, the blade may have ridges or bristles extending from its sides (not shown) for scraping off food stuck to dishes and pans.

To speedup feed of garbage into the disposer or to unclog material which is clogging disposer feed, blade 18 may be inserted into the clogged drain hole and rotated by hand and/or a poking, rocking or other action may be used.

The design of the disposal utensil handle and plug may also be varied to suit different applications of the present invention or for asthetic or manufacturing cost reasons.

In another species of the present invention (not shown), member 12 serves only as a foil-like stop adapted to fit in a drain hole at a distance above a garbage disposer, but does not serve as a plug. In this species of the invention, liquid flows around the edges and/or through holes, slots and the like in member 12. The benefit of utensil 10 serving as a plug is lacking. However, all other aforementioned advantages are retained and this species has the advantage of allowing liquid to drain out of a sink without the necessity of having to remove utensil 10 from the drain hole or cocking it at an angle to let liquid flow out.

It is believed apparent that the invention is not necessarily confined to the specific uses described above since it may be utilized for any purpose to which it may be suited. Nor is the invention necessarily limited to specific construction illustrated and described, since such construction is only intended to be illustrative of the principles of operation, it being considered that the invention comprehends any variations covered by the basic principles disclosed.

What is claimed is:

1. A multi-purpose disposal utensil for use with a garbage disposer comprising:

a plug adapted to fit in a drainhole opening above a garbage disposer;

a handgrip secured to the top side of the plug; and an elongated sweeping-agitating member secured to the bottom side of the plug for sweeping garbage into a garbage disposer drain hole and for urging garbage into the garbage disposer, said sweeping-agitating member adapted to reach substantially all the area in a garbage disposer drainhole above a garbage disposer when said plug is nearly seated in the drainhole opening and manually rotated by the handgrip.

2. A multi-purpose disposal utensil as defined in claim 1 wherein said sweeping-agitating member is a flexible spatula-like blade.

3. The apparatus of claim 2 wherein the flexible spatula-like blade has one square and one rounded corner.

* * * * *